US009066572B2

(12) United States Patent
Mammone

(10) Patent No.: US 9,066,572 B2
(45) Date of Patent: Jun. 30, 2015

(54) COSMETIC APPLICATOR

(75) Inventor: Rocco Mammone, Avondale Heights (AU)

(73) Assignee: Majic Beauty Pty Ltd. (AU)

( * ) Notice: Subject to any disclaimer, the term of this patent is extended or adjusted under 35 U.S.C. 154(b) by 0 days.

(21) Appl. No.: 13/580,143

(22) PCT Filed: Jul. 30, 2010

(86) PCT No.: PCT/AU2010/000967
§ 371 (c)(1),
(2), (4) Date: Feb. 5, 2013

(87) PCT Pub. No.: WO2011/100780
PCT Pub. Date: Aug. 25, 2011

(65) Prior Publication Data

US 2013/0125911 A1 May 23, 2013

(30) Foreign Application Priority Data

Feb. 19, 2010 (AU) ..... 2010900708

(51) Int. Cl.
*A45D 40/26* (2006.01)
*B43K 5/14* (2006.01)
*B05C 11/00* (2006.01)
(Continued)

(52) U.S. Cl.
CPC ..... *A45D 40/26* (2013.01); *A45D 33/005* (2013.01); *A45D 33/02* (2013.01); *A45D 33/18* (2013.01); *A45D 33/34* (2013.01); *A45D 33/38* (2013.01); *A45D 34/04* (2013.01); *A45D 40/0087* (2013.01); *A45D 40/24* (2013.01)

(58) Field of Classification Search
CPC ..... A45D 40/00; A45D 40/26; A45D 40/262; A45D 40/0087; A45D 2200/1009; A45D 2200/1018; A45D 2200/1036; A45D 34/042; A45D 33/005; A45D 33/02; A45D 33/18; A45D 33/34; A45D 33/38; A45D 40/24; B65D 47/42; A34D 34/04; A47L 13/16; A47K 7/02
USPC ..... 132/320, 200, 317, 318, 333, 314; 401/6, 9, 34, 35, 119, 136–139, 183, 401/185, 196, 261, 132–135, 266; 15/209.1, 210.1, 229.14, 104.93, 266; 604/1–3, 306, 310, 303, 309, 313; 602/41, 48
See application file for complete search history.

(56) References Cited

U.S. PATENT DOCUMENTS 1,860,790 A * 5/1932 Schultheiss ..... 401/266
2,209,914 A 7/1940 Gerber et al.
(Continued)

FOREIGN PATENT DOCUMENTS

EP 1 698 562 A2 9/2006

OTHER PUBLICATIONS

Volara, Reilly Foam Corp.,www.reillyfoam.com. (1998).*
(Continued)

*Primary Examiner* — Vanitha Elgart
(74) *Attorney, Agent, or Firm* — Mayback & Hoffman, P.A.; Gregory L. Mayback

(57) ABSTRACT

The invention provides a cosmetic applicator which carries a cosmetic preparation in one or more cavities of the cosmetic applicator thereby allowing the cosmetic preparation to be applied to a skin of the user in a wiping action using only the cosmetic preparation carried by the cosmetic applicator.

36 Claims, 5 Drawing Sheets

(51) Int. Cl.

| | |
|---|---|
| ***A47K 7/02*** | (2006.01) |
| ***A47L 1/06*** | (2006.01) |
| ***A47L 13/10*** | (2006.01) |
| ***A47L 23/04*** | (2006.01) |
| ***A47L 25/00*** | (2006.01) |
| ***B43L 21/00*** | (2006.01) |
| ***A45D 33/00*** | (2006.01) |
| ***A45D 33/02*** | (2006.01) |
| ***A45D 33/18*** | (2006.01) |
| ***A45D 33/34*** | (2006.01) |
| ***A45D 33/38*** | (2006.01) |
| ***A45D 34/04*** | (2006.01) |
| ***A45D 40/00*** | (2006.01) |
| ***A45D 40/24*** | (2006.01) |

(56) References Cited

U.S. PATENT DOCUMENTS

| | | | | |
|---|---|---|---|---|
| 2,606,565 | A * | 8/1952 | Sage, Sr. | 132/320 |
| 3,466,131 | A | 9/1969 | Arcudi | |
| 3,863,654 | A | 2/1975 | Morane et al. | |
| 4,648,506 | A * | 3/1987 | Campbell | 206/216 |
| 4,739,778 | A * | 4/1988 | Christie | 132/320 |
| 4,925,667 | A * | 5/1990 | Fellows et al. | 424/401 |
| 5,287,961 | A * | 2/1994 | Herran | 206/219 |
| 5,490,736 | A * | 2/1996 | Haber et al. | 401/40 |
| 5,904,151 | A * | 5/1999 | Gueret | 132/293 |
| 5,913,318 | A * | 6/1999 | Gueret | 132/293 |
| 5,918,608 | A * | 7/1999 | Renna | 132/320 |
| 6,006,761 | A * | 12/1999 | Meledandri | 132/320 |
| 6,006,916 | A * | 12/1999 | Matsos et al. | 206/581 |
| 6,007,264 | A * | 12/1999 | Koptis | 401/132 |
| 6,044,515 | A * | 4/2000 | Zygmont | 15/209.1 |
| 6,062,234 | A * | 5/2000 | Finocchiaro et al. | 132/320 |
| 6,096,382 | A | 8/2000 | Gueret | |
| 6,119,704 | A * | 9/2000 | Bouchat et al. | 132/320 |
| 6,167,890 | B1 * | 1/2001 | Gueret | 132/200 |
| 6,201,032 | B1 * | 3/2001 | Shyu et al. | 521/84.1 |
| 6,312,181 | B1 * | 11/2001 | Joulia | 401/196 |
| 6,315,482 | B1 * | 11/2001 | Girardot et al. | 401/266 |
| 6,406,206 | B1 * | 6/2002 | Girardot et al. | 401/264 |
| 6,493,898 | B1 * | 12/2002 | Woods et al. | 15/209.1 |
| 6,523,550 | B2 * | 2/2003 | McCormick | 132/320 |
| 6,732,743 | B1 * | 5/2004 | Bouix et al. | 132/200 |
| 6,945,253 | B2 * | 9/2005 | Michel et al. | 132/200 |
| 7,108,440 | B1 * | 9/2006 | Gruenbacher et al. | 401/132 |
| 7,128,925 | B2 * | 10/2006 | D'Auria | 424/401 |
| 7,416,357 | B2 * | 8/2008 | Thiebaut | 401/131 |
| 7,470,077 | B2 * | 12/2008 | Thiebaut et al. | 401/132 |
| 7,785,654 | B2 * | 8/2010 | Nabata et al. | 427/2.3 |
| 8,001,648 | B2 * | 8/2011 | Gueret | 15/244.3 |
| 8,257,718 | B2 * | 9/2012 | Mammone | 424/401 |
| 8,282,945 | B2 * | 10/2012 | Mammone | 424/401 |
| 2001/0017141 | A1 * | 8/2001 | Gueret | 132/320 |
| 2004/0011376 | A1 * | 1/2004 | Michel et al. | 132/320 |
| 2004/0037858 | A1 | 2/2004 | Mammone | |
| 2004/0047673 | A1 * | 3/2004 | Gueret | 401/196 |
| 2006/0257201 | A1 * | 11/2006 | Delage | 401/205 |
| 2006/0272671 | A1 * | 12/2006 | Dobler et al. | 132/320 |
| 2007/0081848 | A1 * | 4/2007 | Ramet | 401/11 |
| 2008/0023025 | A1 * | 1/2008 | Burtzlaff et al. | 132/320 |
| 2008/0105273 | A1 * | 5/2008 | Seeland et al. | 132/200 |
| 2008/0245381 | A1 * | 10/2008 | Iosilevich | 132/200 |
| 2008/0295858 | A1 * | 12/2008 | Dobler et al. | 132/320 |
| 2009/0032053 | A1 * | 2/2009 | Khan et al. | 132/317 |
| 2009/0032054 | A1 * | 2/2009 | Griffiths et al. | 132/320 |
| 2009/0232580 | A1 * | 9/2009 | Castel et al. | 401/41 |
| 2010/0282269 | A1 * | 11/2010 | Uchida et al. | 132/200 |
| 2011/0168198 | A1 * | 7/2011 | Polanish | 132/73 |
| 2011/0247648 | A1 * | 10/2011 | Ikeda et al. | 132/320 |
| 2011/0282243 | A1 * | 11/2011 | Nakatani | 600/580 |
| 2012/0012126 | A1 * | 1/2012 | Arrington | 132/200 |
| 2012/0037180 | A1 * | 2/2012 | Rossi | 132/320 |

OTHER PUBLICATIONS

International Search Report dated Oct. 22, 2010 for Int. Appl. PCT/AU2010/000967, 3 pp.

* cited by examiner

COSMETIC APPLICATOR

FIELD OF THE INVENTION

The present invention relates to the application of cosmetics, and more particularly, to the use of a cosmetic applicator in the application of powdered and liquid cosmetics.

BACKGROUND OF THE INVENTION

Foundation often forms a basis of a user's cosmetic routine. Foundation is a product that is normally used to cover a substantial part of a face of the user rather than being limited to a particular feature of the user such as the eyes or the lips. Sufficient care is required during the application of the foundation in order to achieve an overall smooth, consistent and natural look. However, current modes of application may make it difficult to achieve this desired look.

In order to correctly apply the foundation the user may be required to develop or refine application techniques so that the foundation can be applied to the user's face with a smooth finish. Typical foundation application techniques require the use of a mirror which can make it difficult to correctly apply the foundation. Furthermore, it can happen that the user is rushed when applying makeup to the face of the user. This could lead to the foundation being poorly applied.

Also, tools such as brushes presently on the market often do little to accommodate deficiencies in the technique of the user, for example when the user is first starting out to use foundation, while assisting the user to correctly apply the foundation. Although the user does have the option of seeking the assistance of a specialist such as a beautician, often such help can be costly and time consuming, particularly where the user requires application on a frequent basis.

Furthermore, the tools presently on the market may have a particular design which may require the application of cosmetics in a particular way to achieve a certain finish. The operation of the tools might be difficult to master as often is the case for new users of cosmetics. Sometimes cosmetic users apply foundation using fingers and hands. This can be unhygienic and could lead to the contamination of the foundation product still contained in the foundation bottle. The use of fingers can also create a mess during application as it is highly likely for the user to smear a residue of the foundation left behind after application on other articles of the user, for example a handbag. However, and most importantly, a finger often lacks the ability to achieve a desired effect with a clean, neat and consistent finished rather than a blotchy or messy look.

A further application technique is the use of a foundation brush. Such brushes, though assisting in reaching the corners of the nose, could result in the foundation being applied with one or more streak marks along the face of the user. In such instances, the user may be required to combine multiple techniques in order to remove the streak marks and to achieve the desired effect. Using multiple techniques and therefore multiple applicators can be costly as typically the user is required to purchase different brushes and/or sponges. Furthermore, the use of multiple applicators can be time consuming.

Applying a liquid foundation with a brush can be quite difficult since liquid foundations often dry fairly quickly on a user's skin making it difficult to create a consistent look.

Powder foundations are often applied with a brush. During application powder particles of the foundation is deposited from the brush onto the skin of the user. It could be difficult to achieve a consistent look as already deposited foundation particles can easily be moved by a misplaced brushstroke. As result the user may be required to re-brush some same areas of the face of the user in order to create the desired look. This could result in the application of a powder foundation to take a considerable amount of time. Furthermore, it may be required that the brushes are washed to ensure that the brush has the correct consistency and is kept hygienically clean. This problem may be compounded when different colours of blushes and foundations are used. As a result brushes can be required to be even more frequently washed or aired.

These issues similarly arise with the application of blushes. The difficulty is to ensure that both the user's cheekbones are highlighted in the same manner and are consistent in look. It can be difficult to achieve a consistent look with a blush brush as the desired application relies on the user's skill and equipment. When an error is made in the application of blushes, the user may be required to apply more and more blush in order to create an even look which often results in an undesired effect and the wastage of blush.

Sometimes the user requires the use of two different colours of cosmetics during the application of makeup. Often the user must then apply the two separate colours in two separate application techniques which can be time consuming and difficult for an unskilled user to achieve a desired look.

It can also happen that some of the makeup is unnecessarily wasted as the user may not be able to access all of the makeup in a container so that not all of the cosmetic preparation is capable of being effectively removed from its packaging. For example, the user may not be able to squeeze all of a liquid foundation out of the foundation container.

SUMMARY OF THE INVENTION

It is an aim of the present invention to provide an improved application of cosmetics through the use of a cosmetic applicator to overcome or ameliorate at least one of the above mentioned disadvantages of the prior art.

According to one aspect, the present invention provides a cosmetic applicator and a method of using the same.

The invention provides for a cosmetic applicator providing, in one form for the application of powdered foundation and/or blush, the cosmetic applicator including a body which includes a material surface, a handle portion, a body portion which carries the material surface, and a cosmetic preparation; whereby the cosmetic preparation is retained on an internal surface of the body portion with the assistance of electrostatic attraction between the internal surface and the cosmetic preparation.

In this embodiment, the material surface is a flexible sheet to allow the smooth application of a cosmetic preparation along the contours of the face.

The material surface can be a sponge like material to allow the cosmetic preparation to be stored in the pores of the sponge until use.

A further feature of this embodiment is that the cosmetic preparation can be transferred onto a user's skin through a wiping pass.

The invention provides for a cosmetics application providing, in one form, for the application of liquid foundation and/or blush, the cosmetic applicator including a body which includes a material surface providing a handle portion, a body portion, and a cosmetics preparation; whereby the cosmetic preparation is retained in a capsule on the body portion so that the cosmetic preparation is capable of being released once the capsule is punctured.

In this embodiment, the material surface is a sponge pad to which the capsule is attached.

In a further embodiment, the liquid capsule can be placed on top of the material surface.

The invention provides a method of applying a cosmetic preparation to a skin surface from a cosmetic applicator which also carries the cosmetic preparation prior to use, the method including the step of:

1. transferring the cosmetic preparation from an applicator surface of the cosmetic applicator to the skin surface in a single wiping pass of the cosmetic preparation across the skin surface using only the cosmetic preparation of the cosmetic applicator.

The invention provides a second method of applying a cosmetic preparation to a skin surface from a cosmetic applicator which also carries the cosmetic preparation prior to use in a capsule, the method including the steps of:

1. rupturing the capsule;
2. applying pressure to the capsule thereby releasing the cosmetic preparation onto an applicator surface;
3. transferring the cosmetic preparation from the applicator surface to the skin surface in a single wiping pass of the cosmetic preparation across the skin surface;
4. squeezing the capsule during the wiping pass to provide a release of the cosmetic preparation of the desired amount.

The invention also provides a cosmetic applicator capable of applying in use a cosmetic preparation to skin of a user; the applicator includes a body having at least one retaining formation and including an applicator portion and a handle portion which extends from the applicator portion; the cosmetic preparation is carried by the at least one retaining formation; wherein in use the cosmetic preparation is capable of being transferred from the retaining formation with the applicator portion to the skin of the user.

The at least one retaining formation may be in the form of a cavity which may include an internal surface on which a powder cosmetic preparation is retained with the assistance of electrostatic attraction between the internal surface and the cosmetic preparation.

The at least one retaining formation or cavity may be formed into the applicator portion to have a predetermined cross sectional profile thereby allowing the powder cosmetic preparation to be placed into the at least one cavity so that the powder cosmetic preparation is retained inside the at least one cavity through frictional forces.

The body may include a plurality of cavities each of which extends at feast partly into the applicator portion so that during use the cosmetic preparation is transferred onto the skin through a wiping pass over the skin.

The at least one cavity may define a capsule which includes a cap and which houses a liquid cosmetic preparation; and wherein the liquid cosmetic preparation in use is capable of being released from the capsule by removing the cap.

The capsule may be integrally formed with the handle portion and may be angled relative to the handle portion so that a mouth of the capsule points towards the applicator portion whereby in use the liquid cosmetic preparation is capable of being deposited onto the applicator portion after the removal of the cap.

The applicator portion may be manufactured from a flexible sheet of material including a sponge or woven material.

When the applicator portion is manufactured from a sponge material, the plurality of cavities is in the form of pores of the sponge material thereby allowing the cosmetic preparation to be stored inside the applicator portion.

The handle portion may further include at least one cavity which allows a further cosmetic preparation to be carried by the handle portion. The handle portion may include three cavities two of which hold and trap a cosmetic preparation in the form of a colour pigment or toner with the remaining cavity holding a cosmetic preparation in the form of a blush product.

Each of the cavities carried by the handle portion may include a cover which conceals and protects the contents of the cavity.

Each of the cavities of the handle portion may have at least one socket formation which extends into a base of the cavity thereby allowing part of the cosmetic preparation to be stored inside the at least one socket formation.

The invention further provides a cosmetic applicator capable of applying in use a cosmetic preparation to skin of a user; the applicator includes a body which includes an applicator portion and a handle portion which extends from the applicator portion; wherein the cosmetic preparation is carried by the applicator portion.

The cosmetic preparation may be applied in a number of layers to the applicator portion. In one example of the invention, the cosmetic preparation includes at least two layers one of which is a liquid layer and the other being a powder layer; and wherein the liquid layer binds the powder layer onto the applicator portion. The liquid layer may be first applied to the applicator portion whereafter the powder layer is applied on top of the liquid layer thereby causing the powder layer to stick to the applicator portion. The cosmetic preparation may further include a third layer in the form of a liquid layer which is applied on top of the powder layer thereby to bind particles of the powder layer together.

The cosmetic preparation may be cured. In one example of the invention, the meshing of the powder layer between two liquid layers causes the cosmetic preparation to cure.

The cosmetic preparation may be in the form of a foundation cosmetic. The first, second and third layers may be in the form of foundation cosmetics. Alternatively, the third layer may be a different cosmetic, for example, in the form of a moisturizer, anti-wrinkle cream, or other non-foundation cosmetic.

The body may be manufactured from a flexible sheet of material which allows the handle and applicator portions to be flexible while causing these portions to be firm thereby allowing the cosmetic preparation to be applied to the skin of the user. In one example of the invention the body is manufactured from an elastic finish rubber foam compound. The elastic finish rubber foam compound may be in the form of two pound foam.

The material used in the manufacture of the body may be in the form of Polyethylene-Ethyl Vinyl Acetate (PE-EVA) which has been cross-linked with an electron beam irradiation process. The material may include an additive which promotes the decomposition of the material. The additive may require an aerobic environment in order to enhance and ensure decomposition of the material. The decomposition may be affected by free ranging environmental microbes which consume and great on the PE-EVA polymer.

The elastic finish rubber foam compound may be treated so that an operative side of the body has a textured look. The textured look may be in the form of a pattern which assists in the spreading and blending of the cosmetic preparation across the skin of the user. The elastic finish rubber foam compound may be heat treated to form the pattern.

The handle portion may further include at least one cavity which allows a further cosmetic preparation to be carried by the handle portion. The handle portion may include two cavities one of which holds and trap a cosmetic preparation in the form of a colour pigment or toner with the other cavity holding a cosmetic preparation in the form of a blush product. The colour pigment or toner may allow a shade of the foundation to be made lighter or darker.

The cavity containing the blush product may be covered thereby to conceal and protect the contents of the cavity. The cavity containing the blush product may be covered with a sheet of material, for example a plastics material, which may be transparent thereby to allow ready identification of the colouring of the blush product.

Each of the cavities of the handle portion may have at least one socket formation which extends into a base of the cavity thereby allowing a bulk of the cosmetic preparation to be stored inside the at least one socket formation. Each of the cavities may include a plurality of socket formations.

The cosmetic preparations carried by the cavities may be applied to the skin of the user through partial deformation of the handle portion surrounding each of the cavities thereby to allow the base of a respective cavity to contact the skin. The deformation of the handle portion may be caused by pressure applied to a part of the body into which the cavity extend thereby also causing the cosmetic preparation carried by the at least one socket formation to be forced from the at least one socket formation.

The cavity carrying the blush product may be carried by a section of the handle portion which is detachable from the handle portion.

BRIEF DESCRIPTION OF THE DRAWINGS

A preferred embodiment of the invention will now be described, by way of example only, with reference to the accompanying drawings, in which.

DESCRIPTION OF ILLUSTRATED EMBODIMENTS OF THE INVENTION

Figure 1:
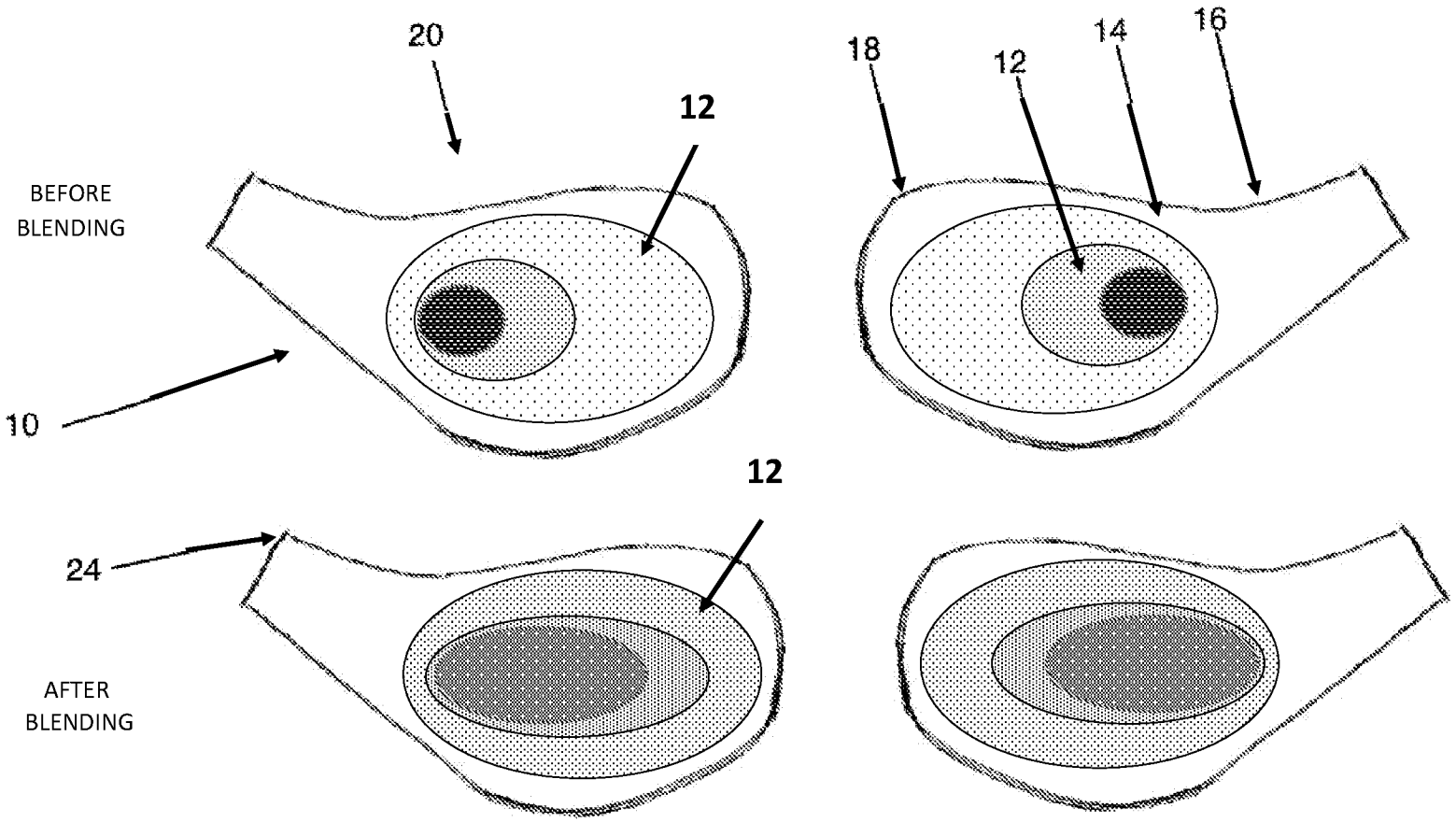
FIG. 1 is a diagrammatic illustration of a cosmetic applicator according to one embodiment of the invention showing before and after use by a user.
Figures 2, 3:
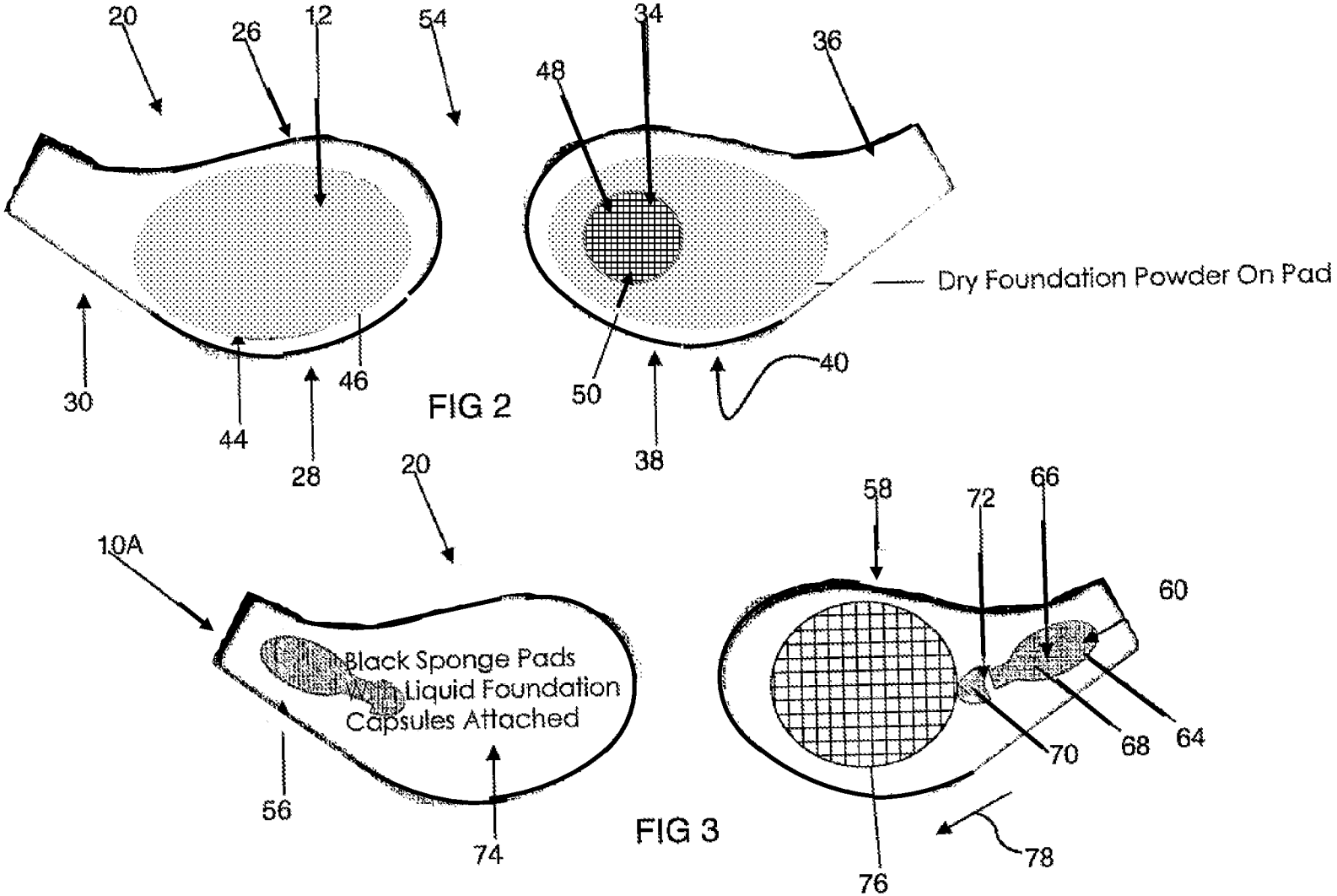
FIG. 2 is a diagrammatic illustration of the cosmetics application for a powdered cosmetic preparation according to a further embodiment of the invention.
FIG. 3 is a diagrammatic illustration of a variation of the cosmetic applicator for use with a liquid cosmetic preparation housed in a capsule of the cosmetic applicator.

FIGS. 1 and 2 of the accompanying representations illustrate a cosmetic applicator 10 according to the invention for the application of a cosmetic preparation 12 in a single wiping pass. The cosmetic applicator includes a body 14 having a handle portion 16 and an applicator portion 18 which extends from the handle portion.

In one embodiment of the invention, the cosmetic applicator 10 can be used in the application of a cosmetic preparation such as a powdered foundation or blush. In this embodiment, the cosmetic applicator 10 has an outer profile 20 which assists the user in applying the cosmetic preparation 12 to skin of the user, not shown. An initial shaping portion 24 begins at the handle portion 16 and follows through to a curved upper portion 26 and then to a lower curved portion 28 following back to a linear shaping portion 30. The linear shaping portion 30 and the initial shaping portion 24 define the handle portion 16. The curved upper portion 26 and the lower curved portion 28 define the body portion of the cosmetic applicator 16. The outer profile 20 and the width and thickness of the cosmetic applicator 10 assist in the transfer efficiency of the wiping action during which a portion of the cosmetic preparation 12 is transferred onto the skin of the user.

The cosmetic applicator 16 has a material surface 34 which carries the cosmetic preparation 12. The material of the material surface 34 is flexible to allow the applicator portion 18 to mould onto the contour of the skin of the user. The flexibility of the material surface and of the applicator portion therefore assists in the uniform distribution of the cosmetic preparation 12 across the skin of the user by allowing the transfer of the cosmetic preparation 12 through a wiping action onto the skin. The material surface 34 of the cosmetic applicator 10 is between 2 to 5 mm thick. However, it is envisage that the thickness can be altered to allow for the desired flexibility for the wiping action in addition to allowing a base, in the form of the body 14, which can effectively carry the cosmetic preparation 12.

The handle portion provides for a finger hold 36 onto which a user can grab using his/her fingers. This allows the user to manipulate the cosmetic applicator without allowing the user's fingers or hands coming into contact with an applicator 38 which consists of the applicator portion 18. The finger hold 36 is not covered with the cosmetic preparation 12. The gripping of the finger hold with the thumb and forefinger will not cause the cosmetic preparation to be contaminated by the fingers of the user. With the cosmetic applicator 10 being held in this way, the index finger can be used to apply pressure to a back 40 of the applicator 38.

The applicator 38 defines an area 44 which is used to apply in use the cosmetic preparation 12. The cosmetic preparation 12 can be a powder foundation or a blush and can be provided in various colours and shades. The cosmetic preparation 12 can comprise a multitude of colours to create a streaking rainbow effect when desired. This may be particularly useful where the user does not want a natural look but a look for dress ups or catwalks.

The applicator 38 is manufactured from a sponge material which contains a plurality of retaining formations or cavities which are formed by pores 46 of the sponge material. The cosmetic preparation 12 is stored inside the pores 46 of the applicator. The applicator 38 may further include, as a covering layer, a layer 48 which is manufactured from polytetrafluoroethylene or PTFE. The PTFE has a low friction coefficient. However, the layer 48 includes a plurality of apertures 50 which allow a portion of the cosmetic preparation 12 to pass through the layer 48 onto the skin of the user during use. Thus, the layer 48 assists in the retention of the cosmetic preparation 12 onto the applicator portion 18 while presenting, due to the low friction coefficient, a low frictional barrier between the applicator portion 18 and the skin of the user. The layer 48 therefore promotes movement of the applicator 38 across the skin of the user in a wiping motion.

The cosmetic applicator 10 typically will be sold for a single application in a suitable packaging. The packaging may be formed as part of a kit housing other beauty items or a combination of the cosmetic applicator 10 in various colours, shapes and sizes. Once the cosmetic applicator 10 is removed from the main packaging, the cosmetic applicator 10 may have a thin plastic material overlaying the cosmetic applicator to prevent unwanted spread of the cosmetic preparation 12 while the cosmetic applicator is packaged. The overlaying plastic material can be transparent to allow the user to see the colour and nature of the cosmetic preparation 12. The overlaying material is peeled back and off to allow usage of the cosmetic applicator 10.

In use the user holds the handle portion 16 of the cosmetic applicator 10 between a thumb and forefinger of the user. As mentioned hereinabove, this allows the forefinger to be positioned adjacent a back 40 of the applicator 38 thereby allowing the user to apply slight pressure on the applicator portion 18. The applicator 38 is then placed on the desired area of the skin of the user and, in a wiping action, the cosmetic preparation 12 is transferred from the applicator 38 to the skin. After use the cosmetic applicator 10 is thrown away.

As the cosmetic applicator 10 can be used for various types of cosmetic preparations 12, FIG. 1 shows an embodiment of the cosmetic applicator in which the cosmetic preparation is a blush. The cosmetic applicator 10 is sold as a pair 54 of left and right cosmetic applicators 10. The advantage in the pair lies in the left and right blush applicators being balanced in volume of the cosmetic preparation 12 thereby to achieve a consistent look on both sides of the face or body. Further, given that the left and right cosmetic applicators 10 contain substantially identical coloured cosmetic preparations, the pair 54 can assists users of various skill levels to achieve consistent application on both sides of the face.

FIG. 1 further illustrates the changing nature of the applicator 38 before and after the wiping motion. It illustrates the spread of colour during the wiping action. Thus, the texture of the applicator portion 18 therefore assists in the blending of the cosmetic preparation during in use. Advantageously, it illustrates (a) the multiple of use of colours thereby allowing efficiency in time and application in applying several colours in one wiping motion, (b) it allows for colours to be used in different functional purposes, such as one colour for blush application and a second colour for contouring the cheekbones and (c) it allows an effective mix of colours to create a natural or other desired effect. Further, the outlining of the applicator 38 in the form of a blush with the outline of a powder foundation further allows for a blending motion with the remaining skin.

FIG. 3 shows a second embodiment 10A of the invention. Like reference numerals are used to designate like components between the cosmetic applicators 10 and 10A. The cosmetic applicator 10A has the same outer profile 20 as the applicator 10 and includes a finger hold 56 and an applicator portion 58. However, the applicator 10A includes a cavity 60 in form of a capsule 64 which houses a liquid cosmetic preparation 66. The capsule 64 is carried by the finger hold 56 to allow the liquid cosmetic preparation to flow onto the applicator portion 58 typically when the capsule is ruptured.

The capsule 64 shown in FIG. 3 is constructed of two components which includes a housing 68 to which is sealingly fitted a cap 70. A line of weakness 72 extends between the cap and the housing thereby allowing the cap to be relatively easily detached from the housing when needed. This allows the cosmetic preparation 66 stored within the housing to be dispensed onto the body portion 58. The user may be required to gently squeeze the housing in order to push the cosmetic preparation out of the housing. The housing is aligned relative to the body portion 58 thereby to allow the discharge of the cosmetic preparation from the housing onto the body portion.

The body portion 58 may be in the form of a powder applicator 74 as disclosed in the first embodiment. This allows the applicator 74 to be used in a dual function. The applicator can be used to apply a liquid foundation with a setting powder to allow the foundation to set evenly and quickly.

In addition, the positioning of the applicator 74 relative to the body portion 58 allows for the material surface 76 on the body portion to be used firstly as an area on which the cosmetic preparation 66 can be deposited from the capsule 64. The material surface 76 may provide for indentations or protrusions to promote the flow of the cosmetic preparation from the housing 68 in a predetermined direction 78. Secondly the body portion 58 assists in the even application of the cosmetic preparation 66 on the skin by providing a distribution effect in which the cosmetic application is dispersed by the shaping and movement of the body portion in use. This promotes a consistent and even distribution of the cosmetic preparation onto the user's skin.

In preparation for use of the cosmetic applicator 10A, the cap 70 is removed from the housing 68. The user then grips the finger hold 56 between a thumb and a forefinger thereby allowing the user to squeeze the housing while at the same time applying pressure to the body portion 58 by pressing down with the forefinger on a back 40 thereof. The user can then manipulate the cosmetic applicator 10A using wiping motions across the skin of the user while squeezing the housing to dispense a required amount of cosmetic preparation onto the body portion 58. The positioning of the forefinger against the back 40 of the body portion allows the user to apply an amount of pressure onto the body portion which is required to coat the skin of the user with a portion of the cosmetic preparation. Thus, the user adds pressure to the housing 68 in order to release a desired volume of cosmetic preparation 66. Once the desired volume is dispensed, the user holds the finger hold 56 between the forefinger and the thumb and, in a wiping motion, wipes the cosmetic applicator 10A over the user's skin. With this motion the user is able to provide continuous pressure to the housing 68. The user is also able dispense more of the cosmetic preparation 66 from the capsule 64 if needed by using squeezing the housing.

The release of the cosmetics preparation 66 can be initiated by various mechanisms. For example, it may be required for the user to squeeze the housing 68 while the cap 70 is still attached to the housing thereby resulting in the discharging of the cosmetic preparation over a large area of the body portion 56. In a further example the cosmetic applicator 10A is one component whereby the pressure or the use of pressure causes the release of the cosmetic preparation through a number of weak points defined across the housing 68. In a further example the capsule 64 must be punctured to allowing the cosmetic preparation to be dispensed through a puncture hole formed in a side wall of the housing 68. In another example, the cavity 60 containing the cosmetic preparation 66 can be covered with a suitable plastic which, when removed, allows the cosmetic preparation to be dispensed onto the body portion 58.

FIG. 3 illustrates the attachment of the cap 70 from the housing 68 while the cosmetic preparation 66 is stored in the capsule 64. FIG. 3 also illustrates the detachment of the cap 70 from the housing 68 during preparation for use of the cosmetic applicator 10A.

Figure 4:
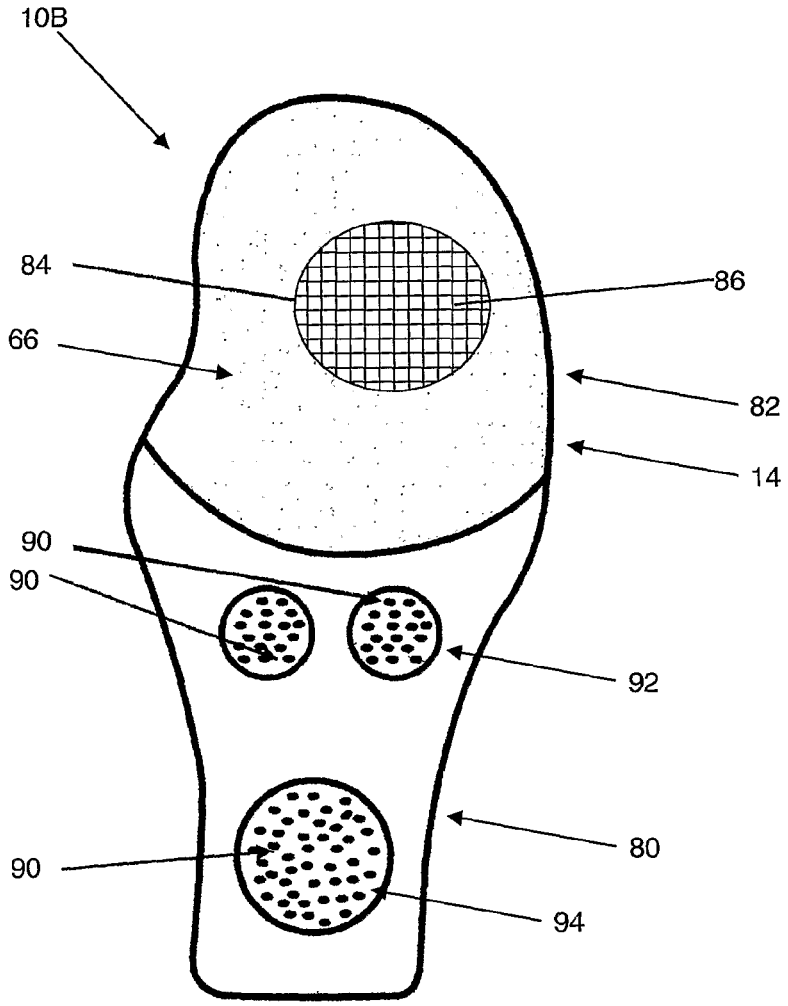
FIG. 4 is a diagrammatic illustration of a further variation of the cosmetic applicator in accordance with the invention.
Figure 5:
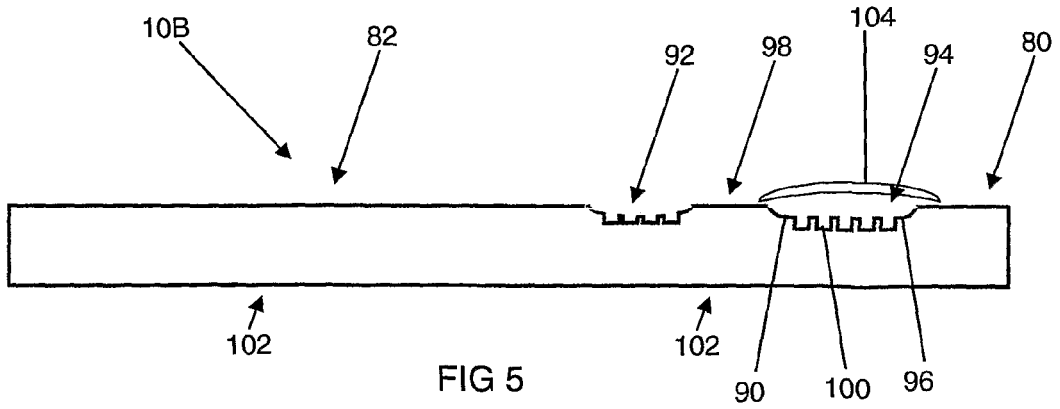
FIG. 5 is a schematic representation, partly sectioned, of a side of the cosmetic applicator of FIG. 4.

FIGS. 4 and 5 show a further variation 10B of the invention. Like reference numerals are used to designate like components between the cosmetic applicators 10 and 10B. The cosmetic applicator 10B has a body 14 which includes a handle portion 80 from which extends a body portion 82. The body portion is manufactured from a material woven pattern sponge 84. The material woven pattern sponge assists in the uniform distribution of the cosmetic preparation, stored inside cavities or textured surface 86 of the material, across the skin of the user. The handle portion 80 further includes three cavities 90 each of which holds a different cosmetic composition 66 such as a colour pigment or toner 92 and a blush 94. Each of the three cavities 90 has a base 96 which extends approximately 1.5 mm into an outer surface 98 of the handle portion 80 and which includes a number of cavities 100 in the form of socket formations which extends around 1.5 mm into the base 96.

The cosmetic applicator 10B can be used in a variety of ways to apply a portion of the cosmetic preparations 66 carried by the cosmetic applicator onto the skin of the user. In one example, the user starts by applying foundation carried by the body portion 82 onto the skin of the user. Depending on the finish which the user desires, some of the colour pigment or toner 92 is deposited using a touch-press motion onto the skin of the user. Typically the user will press against a back 102 of handle portion 80 thereby to press, for example, the colour pigment or toner 92 from the cavities 100. The body portion 82 is then used to spread the colour pigment or toner across a particular area of the skin of the user until a desired result is achieved. Thereafter, if required, the user can apply some of the blush 94 onto selected areas of the skin of the user as required also using the touch-press motion. The blush 94 is also deposited onto the skin of the user with a touch motion. The cavity 90 containing the blush 94 has a cover 104 which protects the blush 94 of the cavity thereby allowing the user to grip the handle portion 80 over the cavity containing the blush product. The cover can be refitted to the cavity after a sufficient quantity of blush 94 has been deposited onto the skin of the user. This allows the user to again grip the handle portion 80 between fingers of the user without one or more fingers of the user coming into contact with the blush.

Figure 6:
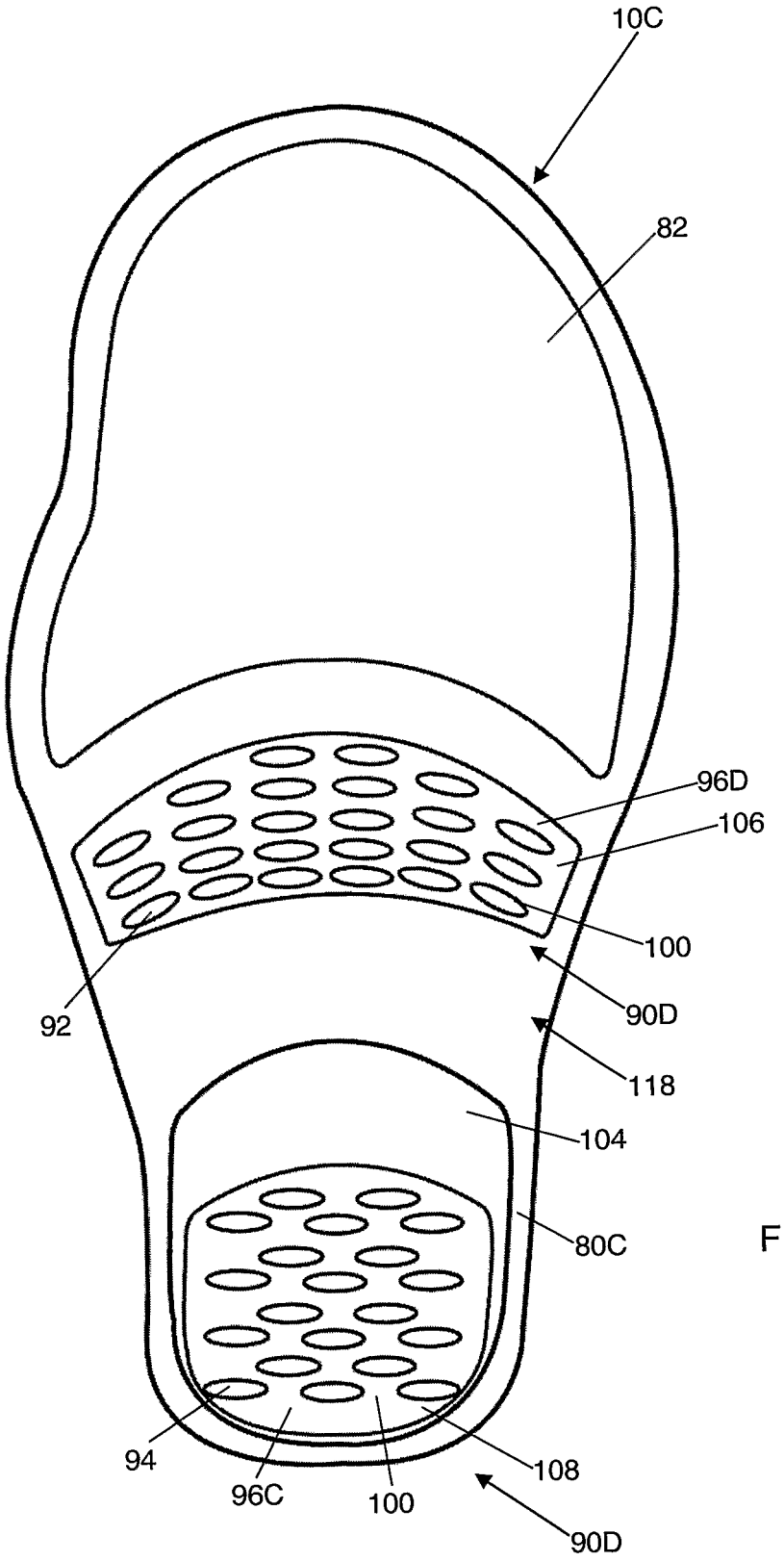
FIG. 6 is a schematic representation of a further variation of the cosmetic applicator in accordance with the invention.

FIG. 6 shows a variation 10C of the cosmetic applicator according to the invention. Like reference numerals are used to designate like components between the cosmetic applicators 10 and 10C. In the applicator 10C the shapes and profiles of the cavities 90 have been changed. The applicator 10C includes a toner containing cavity 106 which extends substantially across the handle portion 80. The toner containing cavity is therefore able to deposit the colour pigment or toner 92 over an increased skin area of the user. Additionally, each of the apertures 100 of the toner containing cavity has an oval shape when viewed in plan so that each aperture has an increased footprint when contacting the skin of the user.

Similarly, a blush containing cavity 108 of the handle portion 80 includes a plurality of cavities or apertures 100 which are oval in shape when viewed in plan.

Referring in particular to FIG. 5 in combination with FIG. 6, it will be noticed that each cavity extends into a base of the toner and blush containing cavities 106 and 108 so that each cavity forms a tube containing either the colour pigment or toner 92 or blush 94. When pressure is applied with a finger of the user from a back 102 of the handle portion 80C to one of toner or blush containing cavities 106 and 108, the apertures 100 become pressurized thereby causing the cosmetic preparation contained within the apertures to be forced out. Thus, a user can deposit some of the cosmetic preparation carried by either of the toner and blush containing cavities onto skin of the user by pressing down onto the back 102 of the handle portion. The pressing of either one of the toner and blush containing cavities onto the skin of the user causes the cavity to slightly deform due to the flexibility of the material used in the manufacture of the cosmetic applicator 10C. This deformation allows the base 96C to move towards the skin of the user until contacting the skin. Further pressure forces some of the cosmetic preparation contained by the apertures 100 to be deposited onto the skin. Therefore, the user can control the amount of cosmetic preparation deposited onto the skin of the user by controlling the amount of pressure applied to the back 102 of the handle portion. The oval shape of the cavities 100 also promotes the depositing of the cosmetic preparations carried by the toner and blush containing cavities over an increased skin area of the user.

The cosmetic preparation 12 is applied in layers to the applicator portion 82D. A liquid layer is first applied to the textured surface of the applicator portion. This is followed by a powder layer which is bound to the textured surface of the applicator portion through the liquid first layer. Thereafter a second liquid layout is applied on top of the powder layer thereby to bind powder particles of the outer layer. The combination of the powder and liquid layers also promotes the curing of the cosmetic preparation.

Figure 7:
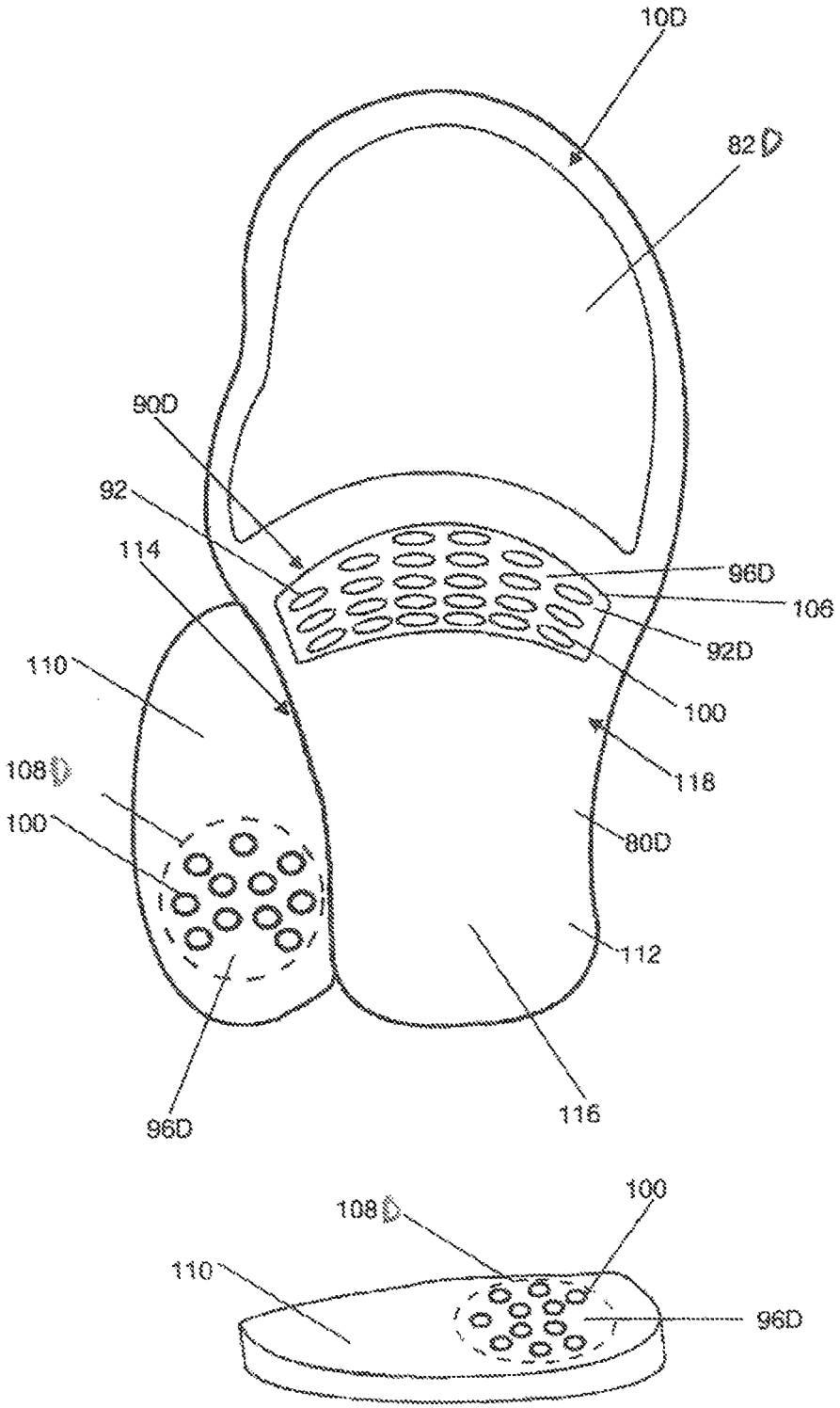
FIG. 7 is a schematic representation of a further variation of the cosmetic applicator of FIG. 6.

FIG. 7 illustrates a variation 10D of the cosmetic applicator 100. Like reference numerals are used to designate like components between the cosmetic applicators 10C and 10D. A handle portion 80D contains a section 110 which is attached with a line of weakness 114 to a remainder 112 of the handle portion. This allows the section to be relatively easily detached from the remainder 112 if so desired during use of the applicator 10D. Thus, a finger hold 116 of the handle portion does not contain the blush containing cavity 108D thereby preventing the cosmetic preparation carried by the blush containing cavity 108D inadvertently being pressed out of the cavities 100 during the operation of the cosmetic applicator 10D.

Element 90D refers to one or more cavities. Element 92D refers to toner. Element 96D refers to one or more bases.

The elastic finish rubber foam compound is in the form of a material which is commonly referred to in the industry as two pound foam. The material used in the manufacture of the body may be in the form of Polyethylene-Ethyl Vinyl Acetate (PE-EVA) which has been cross-linked with an electron beam irradiation process. The material includes an additive which promotes the decomposition of the material.

The additive requires an aerobic environment in order to enhance and ensure decomposition of the material. The decomposition is affected by free ranging environmental microbes which typically found in landfills and which consume and breakdown the PE-EVA polymer. The finished material is a continuous, smooth, non-toxic, irritation—free foam with a fine cell structure and mechanical properties containing no CFC, HCFC, or hydrocarbon blowing agents.

An operative side 118 of the body 14D is heat treated in order to give the operative side of a textured look.

The characteristics of the foam are detailed in Table 1.

TABLE 1

| Foam Typical Physical Properties | units | value |
|---|---|---|
| Density | Pounds Cubic Foot | 1.8-2.2 |
| Compression (ASTM-D3575) | PSI @ 25% | 4.0 |
| Hardness (ASTM-D2240) | A-Scale | 4.0 |
| Water Absorption | Pounds/Square Feet | 0.4 |
| Thickness | Inches | 0.177-0.217 |

The invention provides a cosmetic applicator which allows a user to relatively easily apply a cosmetic product onto a skin of the user. The cosmetic applicator may be sold in pairs of left and right combinations which increase the likelihood of the user achieving an exact same finish on either side of a face of the user. Each of the left and right combination of cosmetic applicators contains the exact same colour and amount of cosmetic preparations, for example foundation, which assists the user in achieving roughly the same finish on either side of the face of the user. The cosmetic applicator makes use of one or more cavities to house the cosmetic preparation during storage or non use. In some instances the cavities are in the form of pores which are formed in a sponge material of the cosmetic applicator. In other instances the cavity is in the form of a flexible capsule or seal which can be broken thereby allow the dispensing of the cosmetic preparation housed in the capsule. In a further instance a textured surface of a materially woven pattern sponge provides a plurality of cavities in which the cosmetic preparation can be stored. The cosmetic applicator includes a flexible applicator portion which allows the cosmetic preparations to be spread across the face of the user with relative ease. Furthermore, the cosmetic applicator includes formations, some in the form of a woven sheet of material and others in the form of grooves and recesses, which assists in the spreading of the cosmetic preparation evenly across the face of the user. The invention also provides a cosmetic applicator which is manufactured from an elastic finish rubber foam compound which is flexible but firm thereby to promote the even application of the cosmetic preparation across skin of the user. The cosmetic preparation is also applied in layers to the applicator portion. A liquid layer is applied onto the textured surface of the applicator portion so thereby to lock a powder layer of the cosmetic preparation onto the applicator portion. A third, liquid layer of the cosmetic preparation is applied on top of the powder layer thereby to keep the particles of the powder layer together. The powder layer also assists in the curing of the cosmetic preparation. The third layer may be a type of cosmetic which is different to the first and second layers. Additionally, the material used in the manufacture of the applicator is biodegradable and allows the applicator to be completely breaking down over a period as little as one year in normal landfills.

While we have described herein a particular embodiment of a cosmetic applicator, it is further envisaged that other embodiments of the invention could exhibit any number and combination of any one of the features previously described. However, it is to be understood that any variations and modifications which can be made without departing from the spirit and scope thereof are included within the scope of this invention.

The invention claimed is:

1. A cosmetic applicator capable of applying in use a cosmetic preparation to skin of a user; the applicator includes a body, with the material used in the manufacture of the body being in the form of Polyethylene-Ethyl Vinyl Acetate (PE-EVA) which has been cross-linked, and the body includes an applicator portion and a handle portion which extends from the applicator portion and cosmetic preparation carried by the applicator portion; and wherein in use the cosmetic preparation is transferred from the applicator portion to the skin of the user wherein the handle portion includes at least one storage cavity which allows a further cosmetic preparation to be carried by the handle portion.

2. A cosmetic applicator according to claim 1 wherein the handle portion includes two storage cavities one of which holds and trap a cosmetic preparation in the form of a colour pigment or toner with the other cavity holding a cosmetic preparation in the form of a blush product.

3. A cosmetic applicator according to claim 2 wherein the colour pigment or toner is capable of being used by the user to adjust a shade of the cosmetic preparation.

4. A cosmetic applicator according to claim 2 wherein the storage cavity containing the blush product may be covered thereby to conceal and protect the contents of the storage cavity.

5. A cosmetic applicator according to claim 4 wherein the storage cavity containing the blush product is covered with a sheet of material manufactured from a plastics material which is transparent thereby to allow ready identification of the colouring of the blush product.

6. A cosmetic applicator according to claim 2 wherein each of the storage cavities of the handle portion includes at least one socket formation which extends into a base of the storage cavity thereby allowing a bulk of the cosmetic preparation to be stored inside the at least one socket formation.

7. A cosmetic applicator according to claim 6 wherein each of the storage cavities includes a plurality of socket formations.

8. A cosmetic applicator according to claim 6 wherein the cosmetic preparations carried by the storage cavities are applied to the skin of the user through partial deformation of the handle portion surrounding each of the cavities thereby to allow a base of a respective storage cavity to contact the skin.

9. A cosmetic applicator according to claim 8 wherein the deformation of the handle portion is caused by pressure applied to a part of the body into which a respective storage cavity extends thereby to cause the cosmetic preparation carried by the plurality of socket formations to be forced from the at least one socket formation.

10. A cosmetic applicator according to claim 9 wherein the storage cavity carrying the blush product is carried by a section of the handle portion which is detachable from the remainder of the handle portion.

11. A cosmetic applicator according to claim 1 wherein the applicator portion includes a material surface, a handle portion, whereby the cosmetic preparation is retained on an internal surface of the applicator portion with the assistance of electrostatic attraction between the internal surface and the cosmetic preparation.

12. An applicator according to claim 11 wherein the material surface is a flexible sheet in the form of a sponge like material to allow the cosmetic preparation to be stored in pores of the sponge until use; and wherein the flexible sheet allows the smooth application of a cosmetic preparation along contours of a face of the user.

13. A cosmetics application according to claim 1 which is capable of being used to apply a cosmetic preparation to skin of a user, whereby the cosmetic preparation is retained in a capsule on the body so that the cosmetic preparation is capable of being released once the capsule is punctured.

14. An applicator according to claim 13 wherein a surface of the material is a sponge pad to which the capsule is attached.

15. An applicator according to claim 13 wherein the capsule is embedded in material used in the manufacture of a surface of the material.

16. An applicator according to claim 1 which also carries the cosmetic preparation prior to use, wherein applying a cosmetic preparation to a skin surface from the applicator includes the step of transferring the cosmetic preparation from an applicator surface of the cosmetic applicator to the skin surface in a single wiping pass of the cosmetic preparation across the skin surface using only the cosmetic preparation of the cosmetic applicator.

17. An applicator according to claim 1 which also carries the cosmetic preparation prior to use in a capsule, wherein applying a cosmetic preparation to a skin surface from the applicator includes the steps of:

a. rupturing the capsule;

b. applying pressure to the capsule thereby releasing the cosmetic preparation onto an applicator surface;

c. transferring the cosmetic preparation from the applicator surface to the skin surface in a single wiping pass of the cosmetic preparation across the skin surface;

d. squeezing the capsule during the wiping pass to provide a release of the cosmetic preparation of the desired amount.

18. A cosmetic applicator according to claim 1, wherein the material used in the manufacture of the body is in the form of PE-EVA which has been cross-linked with an electron beam irradiation process.

19. A cosmetic applicator according to claim 1 wherein the cosmetic preparation is applied in a number of layers to the applicator portion.

20. A cosmetic applicator according to claim 19 wherein the cosmetic preparation includes at least two layers one of which is a liquid layer and the other being a powder layer; and wherein the liquid layer binds the powder layer onto the applicator portion.

21. A cosmetic applicator according to claim 20 wherein the liquid layer is first applied to the applicator portion whereafter the powder layer is applied on top of the liquid layer thereby causing the powder layer to stick to the applicator portion.

22. A cosmetic applicator according to claim 21 wherein the cosmetic preparation further includes a third layer in the form of a liquid layer which is applied on top of the powder layer thereby to bind particles of the powder layer together.

23. A cosmetic applicator according to claim 22 wherein the meshing of the powder layer between two liquid layers causes the cosmetic preparation to cure.

24. A cosmetic applicator according to claim 23 wherein the cosmetic preparation is in the form of a foundation cosmetic; and wherein the first, second and third layers are in the form of foundation cosmetics.

25. A cosmetic applicator according to claim 23 wherein the cosmetic preparation is in the form of a foundation cosmetic; wherein the first and second layers are in the form of foundation cosmetics; and wherein the third layer is formed using a non-foundation cosmetic.

26. A cosmetic applicator according to claim 25 wherein the cosmetic used to form the third layer is in the form of a moisturizer or anti-wrinkle cream.

27. A cosmetic applicator according claim 1 wherein the cosmetic preparation is cured.

28. A cosmetic applicator according to claim 1 wherein the body is manufactured from a flexible sheet of material which allows the handle and applicator portions to be flexible while causing these portions to be firm thereby allowing the cosmetic preparation to be applied to the skin of the user.

29. A cosmetic applicator according to claim 28 wherein the body is manufactured from an elastic finish rubber foam compound.

30. A cosmetic applicator according to claim 29 wherein the material used in the manufacture of the body is in the form of Polyethylene-Ethyl Vinyl Acetate (PE-EVA) which has been cross-linked with an electron beam irradiation process.

31. A cosmetic applicator according to claim 30 wherein the material includes an additive which promotes the decomposition of the material.

32. A cosmetic applicator according to claim 31 wherein the additive requires an aerobic environment in order to enhance and ensure decomposition of the material.

33. A cosmetic applicator according to claim 32 wherein the decomposition is affected by free ranging environmental microbes which consume and great on the PE-EVA polymer.

34. A cosmetic applicator according to claim 29 wherein the elastic finish rubber foam compound is treated so that an operative side of the body has a textured look.

35. A cosmetic applicator according to claim 34 wherein the textured look is in the form of a pattern which assists in the spreading and blending of the cosmetic preparation across the skin of the user.

36. A cosmetic applicator according to claim 34 wherein the elastic finish rubber foam compound is heat treated to form a pattern.

* * * * *